US005929745A

United States Patent [19]

Tsunezawa et al.

[11] Patent Number: 5,929,745

[45] Date of Patent: Jul. 27, 1999

[54] HIGH-VOLTAGE ELECTRIC COMPONENT

[75] Inventors: Ichiro Tsunezawa, Toyama; Motoharu Higami, Shimo-mura, both of Japan

[73] Assignee: Hokuriku Electric Industry Co., Ltd., Toyama Pref., Japan

[21] Appl. No.: 08/829,695

[22] Filed: Mar. 26, 1997

[30] Foreign Application Priority Data

Mar. 29, 1996 [JP] Japan ..... 8-076734

[51] Int. Cl.[6] ..... H01C 10/32

[52] U.S. Cl. ..... 338/160; 338/276; 338/322; 338/329; 338/220; 338/162; 361/743

[58] Field of Search ..... 338/118, 160, 338/162, 70, 276, 220, 322, 329; 361/743, 738

[56] References Cited

U.S. PATENT DOCUMENTS

| | | | |
|---|---|---|---|
| 2,740,026 | 3/1956 | Budd et al. | 338/172 |
| 3,173,120 | 3/1965 | Marks et al. | 338/36 |
| 3,358,258 | 12/1967 | Kirkendall | 338/183 |
| 4,214,353 | 7/1980 | Kalina | 29/25.42 |
| 4,429,297 | 1/1984 | Nakatsu | 338/162 |
| 5,157,371 | 10/1992 | Sundquist et al. | 338/162 |
| 5,508,678 | 4/1996 | Tsunezawa et al. . | |

FOREIGN PATENT DOCUMENTS

| | | | |
|---|---|---|---|
| 2806683 | 8/1979 | Germany | 338/322 |
| 1164002 | 6/1989 | Japan | 338/322 |
| 3-7 | 1/1991 | Japan . | |
| 5-17842 | 5/1993 | Japan . | |
| 6-53001 | 2/1994 | Japan . | |
| 6-290902 | 10/1994 | Japan . | |

OTHER PUBLICATIONS

JP 8–31619 English translation, Keisawa, Feb. 1996, US class 338/162.

*Primary Examiner*—Michael L. Gellner
*Assistant Examiner*—Karl Easthom
*Attorney, Agent, or Firm*—Pearne, Gordon, McCoy & Granger LLP

[57] ABSTRACT

A high-voltage variable resistor unit including a terminal connection structure capable of preventing upward movement or rotation of the terminal by simple construction. A terminal is provided with a connecting portion between a held portion and a lead wire connected portion. A terminal fixing portion of the insulating casing is provided adjacent to a terminal holding portion with a connecting portion receiving recess in which the connecting portion of the terminal is received. An insulating resin is charged in the connecting portion receiving recess and hardened. The walls surrounding the connecting portion receiving recess have a pair of grooves each formed on a pair of walls facing to a first linear connecting portion and a second linear connecting portion of the terminal.

13 Claims, 5 Drawing Sheets

HIGH-VOLTAGE ELECTRIC COMPONENT

BACK GROUND OF THE INVENTION

This invention relates to an electric component such as a high voltage variable resistor unit, and more particularly to a high voltage variable resistor unit and a fly-back transformer.

An electric component for a high voltage (hereinafter referred to as "high-voltage electric component") such as a high-voltage variable resistor unit, commonly called a focus pack is generally provided with terminals at an edge of an insulating casing for connecting a lead wire by soldering. Conventionally, a terminal fixing portion at an edge of the insulating casing is provided with one or more than one terminal holding portion having a pair of holding elements for holding a part of the terminal (Japanese Patent Laid-open Publication No. 290902/1994 and U.S. Pat. No. 5,508,678, FIG. 1B). Unfortunately, the construction just to hold the terminal tends to cause a problem that excessive force to the terminal allows upward movement of the terminal, which prevents proper positioning of the terminal. Another problem is that the terminal, which is formed by bending a rod, stick or wire conductor, supported by the holding portion tends to rotate. In view of the problems, various approaches have been conventionally employed such as to melt the terminal holding portion (Japanese Utility Model Laid-open Publication No. 7/1991), or to provide a projection at the terminal fixing portion of the insulating casing for engaging with a portion of the terminal (Japanese Patent Laid-open Publication No. 53001/1994) so as to prevent the upward movement or rotation of the terminal.

In the publication of Japanese Utility Model Publication No. 17842/1993, the construction that an insulating substrate provided with a variable resistor circuit pattern on the surface is received in a substrate receiving chamber of an insulating casing is disclosed, wherein a terminal holding portion integrally formed on the insulating casing holds a portion of the terminal. In the construction especially shown in FIG. 5 of this publication, the terminal formed by bending a plate-like conductor is provided with a through hole. The terminal is tentatively fixed by fitting a projection formed at a terminal fixing portion of the insulating casing into the through hole. In this state, a space for a resin is formed between a bending portion, which is formed by bending a portion of the terminal, and the inner surface of the insulating casing. The insulating resin charged in the rear side of the insulating substrate is also charged into the space by action of surface tension. Thus, the terminal is fixedly secured to the terminal fixing portion of the insulating casing by the charged and hardened resin in the space.

However, the conventional construction still has such problems that the yield rate decreases due to the failure in melting the terminal holding portion, and that the terminal positioning is not secured due to the lack of the fixing strength. Therefore, when an unexpected large stress is applied to the terminal in the process of manufacturing, packaging or transportation, the upward movement or rotation of the terminal occurs which leads to inferiority of soldering. In an actual assembling of the high-voltage electric components such as a high-voltage variable resistor or a fly-back transformer into an electric appliance, in which such an electric component is used, the improper positioning of the terminal prevents facilitating smooth assembling and, moreover, such an electric component can not be used at all as mal-equipped.

The prior art disclosed in Japanese Utility Model Publication No. 17842/1993 has a problem that the terminal moves or inclines before the insulating resin becomes hard. Thus, the terminal fixing is so troubling and the possibility of poor equipment of the terminal increases. Further, the art disclosed in this publication has another problem that the art is not applicable to the terminal formed by bending a rod, stick or wire conductor, unless some modification is made to the construction.

SUMMARY OF THE INVENTION

The present invention has been made in view of the foregoing disadvantage of the prior art.

Accordingly, it is an object of the present invention to provide a high-voltage electric component, a high-voltage variable resistor unit or a fly-back transformer which is capable of effectively preventing the terminal from inclining or moving before the insulating resin for fixing the terminal is charged.

It is another object of the invention to provide a high-voltage electric component, a high-voltage variable resistor unit or a fly-back transformer which is capable of tentatively but securely fixing the terminal formed by bending a wire conductor to the terminal fixing portion of the insulating casing before the insulating resin for fixing the terminal is charged.

It is another object of the invention to provide a high-voltage electric component, a high-voltage variable resistor unit or a fly-back transformer which enables selection of the fixing position and the number of the terminals to some extent.

It is another object of the invention to provide a high-voltage electric component or a high-voltage variable resistor unit which is capable of facilitating fixing of the terminals even when there are plural terminals.

It is another object of the invention to provide a high-voltage electric component or a high-voltage variable resistor unit which is capable of preventing transformation of the portion of the terminal to which a lead wire is connected by soldering.

In accordance with the present invention, a high-voltage electric component is provided. The high-voltage electric component includes an insulating casing having a one-side-open receiving chamber, an electric component received in the receiving chamber, a terminal fixing portion integrally formed with the insulating casing adjacent to the receiving chamber, one or more than one terminal holding portion having at least a pair of holding elements provided at a rear side of the terminal fixing portion, that is, on a surface portion of the terminal fixing portion at an opening side of the receiving chamber, and one or more than one terminal having a held portion held by at least a pair of holding elements and a lead wire connected portion for connecting a lead wire by soldering which extends from the electric component received in the receiving chamber, and an insulating resin is charged and hardened in the receiving chamber. In this invention, the terminal which has a connecting portion between the held portion and the lead wire connected portion for connection of both portions is used. This invention is effective especially for the terminal formed by bending a wire conductor. The terminal fixing portion of the insulating casing is formed with one or more than one connecting portion receiving recess for receiving the connecting portion of the terminal adjacent to the terminal holding portion. One or more than one connecting portion receiving recess opens toward the same side as the receiving chamber of the insulating casing opens. The connecting portion of one and more than one terminal and one and more than one connecting portion receiving recess are constructed to keep positioning of one and more than one terminal in such a state that the connecting portion being received in the connecting portion receiving recess and the held portion of one and more than one terminal being held by the terminal holding portion. The terms, "keep positioning" referred to here mean to hold or support the terminal so as not to incline, move or rotate. The resin is charged into the connecting portion receiving recess and hardened in the state that the connecting portion of the terminal being received in the connecting portion receiving recess.

Thus, as the connecting portion of the terminal is received in the connecting portion receiving recess, which is then filled with the insulating resin, the connecting portion of the terminal can be fixed in the hardened insulating resin, therefore the upward movement or rotation of the terminal can be prevented.

Further, in accordance with this invention, as the connecting portion of the terminal and the connecting portion receiving recess are constructed to keep positioning of the terminal before the insulating resin is charged and hardened, the movement of the terminal can be prevented until the insulating resin is charged and hardened, which enables easy attachment of the terminal. Also, as more than one connecting portion receiving recesses are integrally formed on the terminal fixing portion adjacent to the receiving chamber in the insulating casing, the terminal positioning can be made in a wider selection than in the prior arts, in which a portion of the terminal is received in a receiving portion in the insulating casing. Furthermore, the construction enables to expand the clearance for insulation between the electrodes and the terminals positioned within the receiving chamber. The number of the terminal attached to the terminal fixing portion can be increased easily.

The connecting portion receiving recess can be formed integrally with the insulating casing. One connecting portion receiving recess is provided for one terminal, however, when a plurality of terminals are provided adjacently, the connecting portion receiving recesses provided for the terminals can communicate with each other by providing communication grooves. This structure facilitates charging of the insulating resin into each connecting portion receiving recess, as a result, the manufacturing time and cost can be reduced.

The resin charged in the connecting portion receiving recess can be any insulating resin which can fix the terminal after hardened. However, in the high-voltage electric component, the receiving chamber is filled with the insulating resin for insulation molding, which can be also charged to the connecting portion receiving recess. In this case, if the connecting portion receiving recess communicates with the receiving chamber by a communication groove, charging of the insulating resin into the receiving chamber allows the insulating resin to flow into the connecting portion receiving recess simultaneously. Thus, a separate charging of the insulating resin into the connecting portion receiving recess can be eliminated, therefore, the manufacturing process can be reduced and the manufacturing time can be shortened.

This invention is also applicable to a fly-back transformer including a high-voltage variable resistor unit attached to a transformer casing of the fly-back transformer. In assembling the transformer, most of the terminals have been embedded in the insulating resin which molds the transformer, so that if upward movement or rotation occurs to the terminals and then the insulating resin for molding the transformer is charged, the positioning of the terminals can not be modified, which leads the fly-back transformer to a mal-equipped one. Therefore, if this invention is applied to the fly-back transformer, it will be a great advantage that the yield rate increases considerably.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

A high-voltage variable resistor unit according to the present invention will be described hereinafter with reference to the accompanying drawings.

Figure 5:
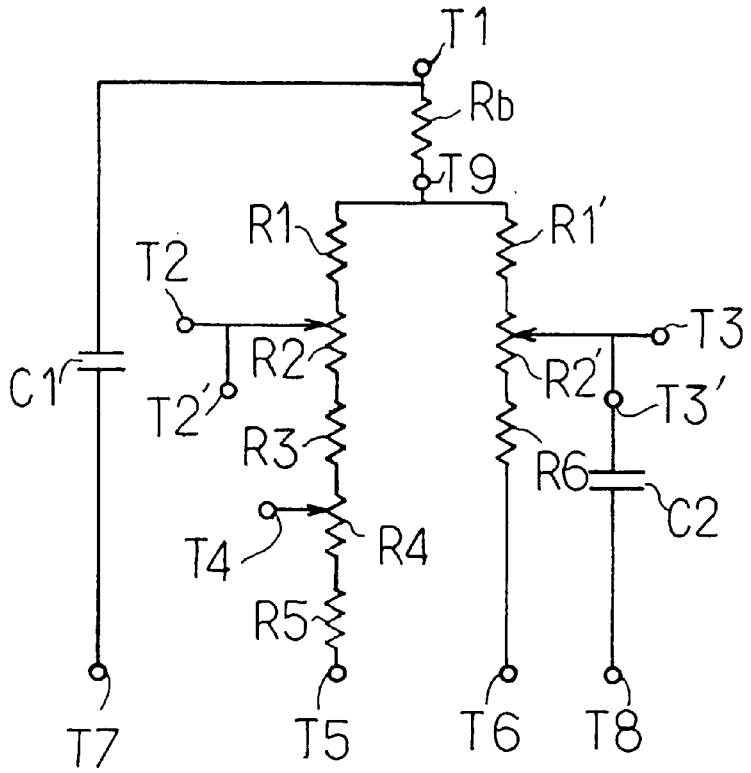
FIG. 5 is a circuit diagram of the high-voltage variable resistor unit shown in FIG. 1.

Referring to FIGS. 1 to 4, an embodiment of a high-voltage variable resistor unit according to the present invention is illustrated. A high-voltage variable resistor unit of the illustrated embodiment is a generally called double focus type high-voltage variable resistor unit which outputs two focus voltages and a screen voltage, the circuit of which is illustrated in FIG. 5. Capacitors C1 and C2 are not shown in FIGS. 1 to 4.

The high-voltage variable resistor unit of the illustrated embodiment includes an insulating casing 1 integrally molded from an insulating resin material having an opening formed on a bottom of it. The insulating casing 1 is provided therein with a substrate receiving chamber or, a board receiving chamber 3 and a L-shaped electric component receiving chamber 7 which receives a fixed resistor circuit board 5 providing a bleeder resistor Rb (FIG. 5) and a capacitor C1 (FIG. 5). The board receiving chamber 3 includes a circuit board, or insulating substrate 2 formed on a surface with electric elements such as a variable resistor circuit pattern shown in FIG. 5 excepting for the capacitor C1, a capacitor C2 and a bleeder resistor Rb. The variable resistance circuit pattern includes two variable resistors R2 and R2', each for adjusting each of two focus voltage outputs and a variable resistor R4 for adjusting a screen voltage output. R1 to R6 are fixed resistors. Each element shown by the indication number from T1 to T9 in FIG. 5 corresponds to a terminal or input/output element shown in FIGS. 1 to 4 bearing the same indication, T1 to T9, respectively. Three sliders sliding on the three variable resistors R2, R2' and R4 are provided between the insulating substrate 2 and an upper wall section 9 (FIG. 1) of the insulating casing 1.

Between the upper wall section 9 of the insulating casing 1 and the insulating substrate, slider supporting portions of three slider operating members (11, 13, 15) are arranged. The slider supporting portions are formed for mounting sliders on the slider operating members (11, 13, 15), each having an operating shaft (11*a*, 13*a*, 15*a*) arranged in a manner to rotatably extend through the upper wall section 9 of the insulating casing 1. The slider operating members 11 and 13 serve to operate the sliders which slide on the variable resistors R2 and R2' for outputting two focus voltages, and the slider operating member 15 serves to operate a slider which slides on the variable resistor R4 for outputting a screen voltage. The insulating casing 1 is formed integrally on the upper wall section with two expansions, a first expansion 17 for receiving two slider supporting portions and a second expansion 19 for receiving another slider supporting portion. The first expansion 17 receives two slider supporting portions each for the slider operating members 11 and 13 each supporting a slider for adjusting focus voltage output. The second expansion 19 receives a slider supporting portion for the slider operating member 15 supporting a slider for adjusting screen voltage output. The first expansion 17 for receiving slider supporting portions and the second expansion 19 for receiving a slider supporting portion are formed on the insulating casing 1 linearly in a longitudinal direction thereof.

Two output terminal constructions (not shown), each for outputting a focus voltage, and an output terminal construction (not shown) for outputting a screen voltage are provided between the upper wall section 9 of the insulating casing 1 and the insulating substrate. The output terminal construction each electrically connected to the corresponding slider has a core line holding portion for holding without soldering a core line of an output lead wire (not shown), which is inserted extending through the insulating casing 1. The upper wall section 9 of the insulating casing 1 is integrally formed with a first, a second and a third expansions 21, 23, 25, each having a portion for receiving a core line holding portion (21*a*, 23*a*, 25*a*) and a portion for receiving a portion of an output lead wire (21*b*, 23*b*, 25*b*) of the corresponding output terminal construction. The first and the second expansions 21 and 23 are provided at either side of the first expansion 17 for receiving slider supporting portion. The first expansion 17 for receiving slider supporting portion and the first and the second expansions 21, 23 each for receiving a core line holding portion are formed interconnected with each other. The first expansion 21 for receiving a core line holding portion extends away from the second expansion 19 for receiving a slider supporting portion and the second expansion 23 for receiving a core line holding portion extends toward the second expansion 19 for receiving a slider supporting portion. The third expansion 25 for receiving a core line holding portion extends in the same direction as the second expansion 23 for receiving a core line holding portion extends, and the second expansion 19 for receiving a slider supporting portion and the third expansion 25 for receiving a core line holding portion are formed interconnected with each other. The reference numeral 27 designates a capacitor receiving expansion for receiving the capacitor C1. The reference numerals 29 and 31 designate supporting portions for supporting the insulating casing 1 horizontally above the apparatus in assembling the units with the rear side of the insulating casing 1 being turned up. The reference numeral 32 is a projection for determining the position of the insulating casing 1 to the apparatus.

The reference numerals T2 to T4 in FIGS. 1 to 4 are the portions for inserting the lead wires which correspond to the output elements shown in FIG. 5 bearing the same indications T2 to T4.

The insulating casing 1 is integrally formed with three supporting elements 35, 37, 39 for supporting and fastening two lead wires to the insulating casing 1 as the lead wires inserted into the second and the third expansions 23, 25 for receiving a core line holding portions are pulled along with a side wall portion 33 of the insulating casing 1 in the direction that the first expansion 21 for receiving a core line holding portion extends. The supporting element 35 is integrally formed with a plate-like terminal fixing portion 41 provided integrally at one end of the insulating casing 1 in a longitudinal direction, that is, the side along the line that the first expansion 17 for receiving a slider supporting portion and the second expansion 19 for receiving a slider supporting portion stand. The supporting element 37 is integrally formed with the supporting portion 31, and the supporting element 39 is integrally formed with the first expansion 21 for receiving a core line holding portion.

Figure 1:
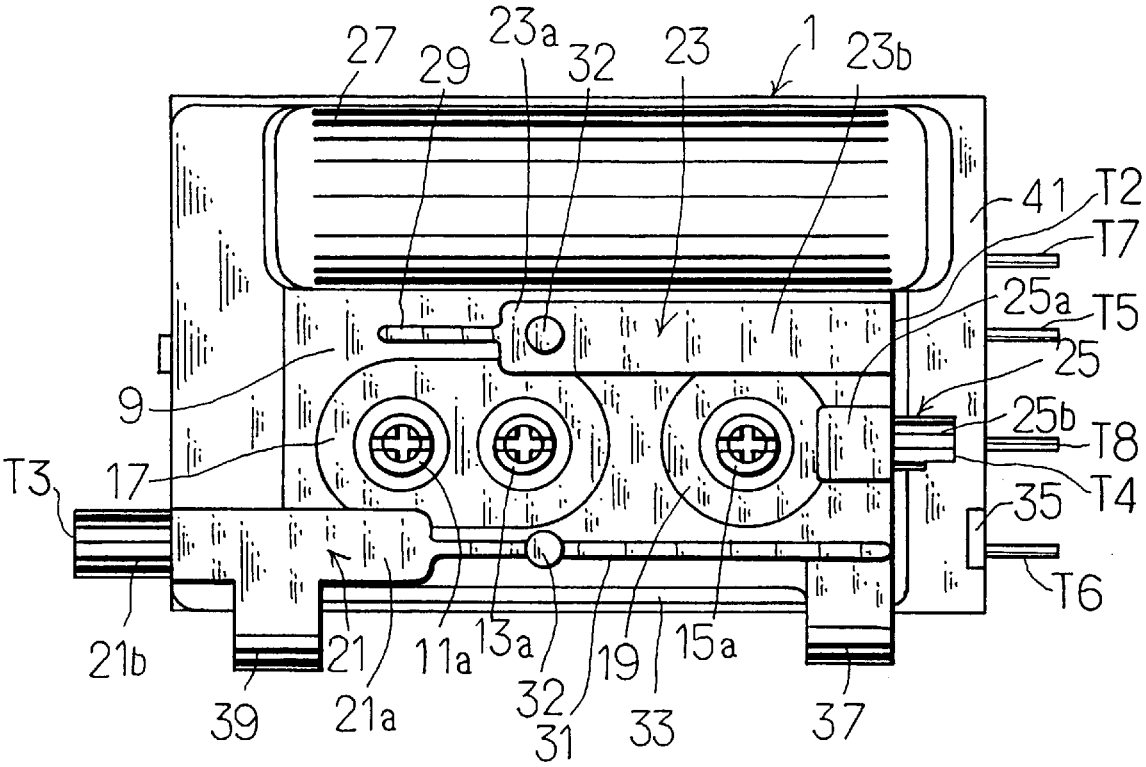
FIG. 1 is a plan view of an embodiment of a high-voltage variable resistor unit according to the present invention.
Figure 2:
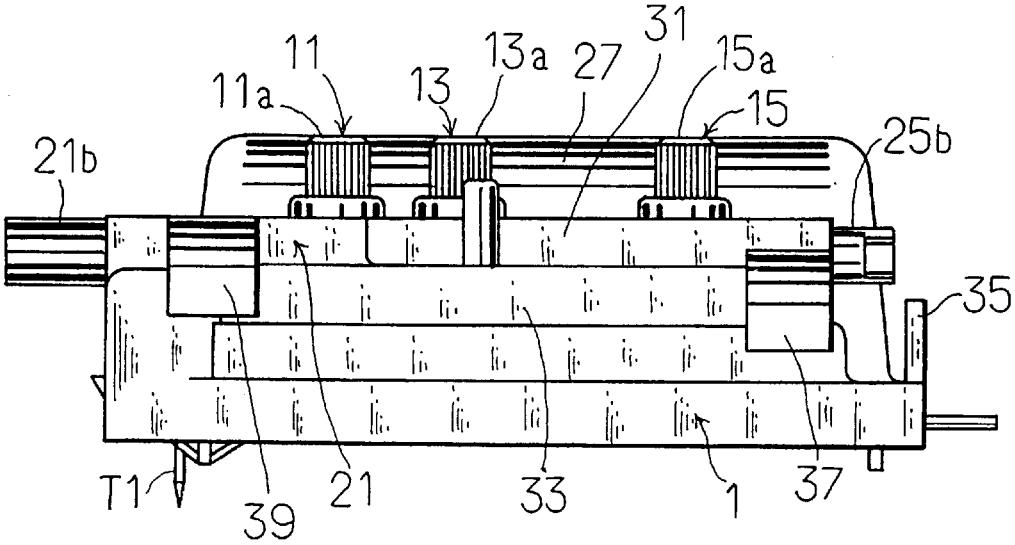
FIG. 2 is a front view of the high-voltage variable resistor unit own in FIG. 1.
Figure 3:
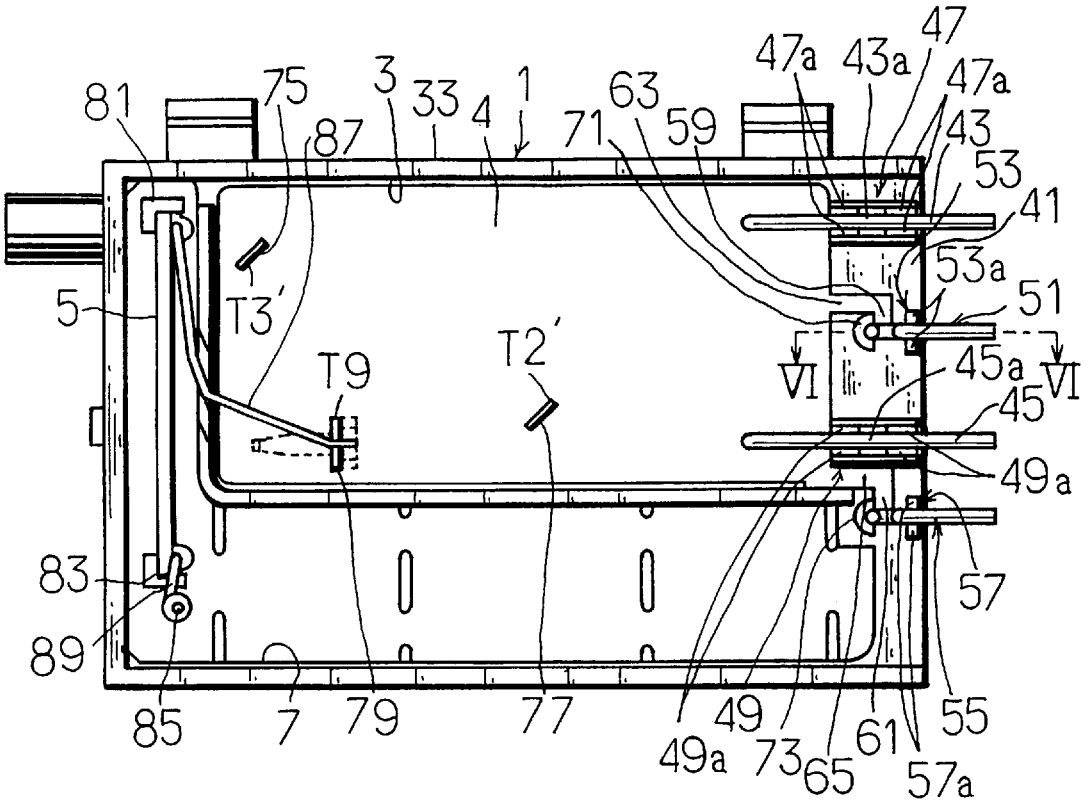
FIG. 3 is a bottom view of the high-voltage variable resistor unit shown in FIG. 1.
Figure 4:
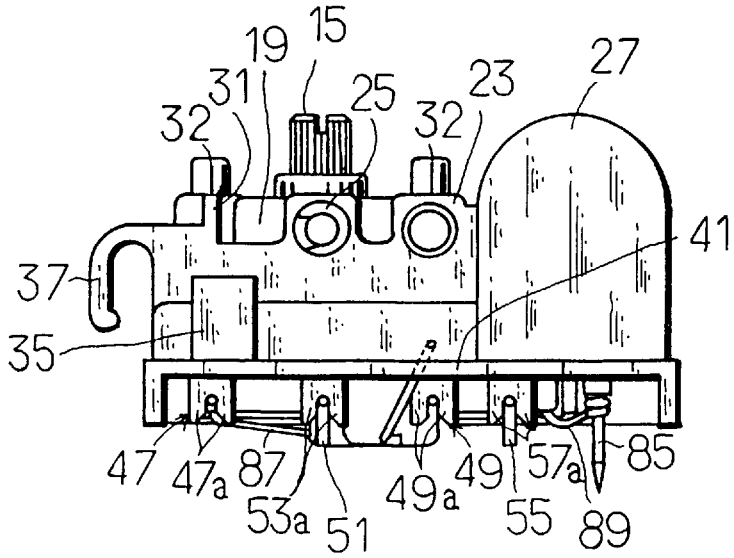
FIG. 4 is a side view of the high-voltage variable resistor unit shown in FIG. 1.

As shown in FIG. 3, the rear side of the terminal fixing portion 41 is integrally formed with terminal holding portions 47 and 49 for holding held portions 43*a* and 45*a* of earthing terminals 43 and 45, one end of each terminal being connected by means of soldering to the electrode T5 or T6 shown in FIG. 5. The terminal holding portions 47 and 49 include a pair of holding elements 47*a*, 47*a*. In this preferred embodiment, two pairs of the holding elements are provided for each terminal holding portions 47 and 49 along the longitudinal direction of the held portions of 43*a* and 45*a* of the terminals 43 and 45.

The terminal fixing portion 41 is integrally formed with a terminal holding portion 53 for holding a terminal 51 between the earthing terminals 43 and 45, and a terminal holding portion 57 for holding a terminal 55 at a position near the end of the electric component receiving chamber 7. These terminal holding portions 53 and 57 each are provided with a pair of holding elements 53*a*, 53*a* and 57*a*, 57*a*, respectively.

Figure 6:
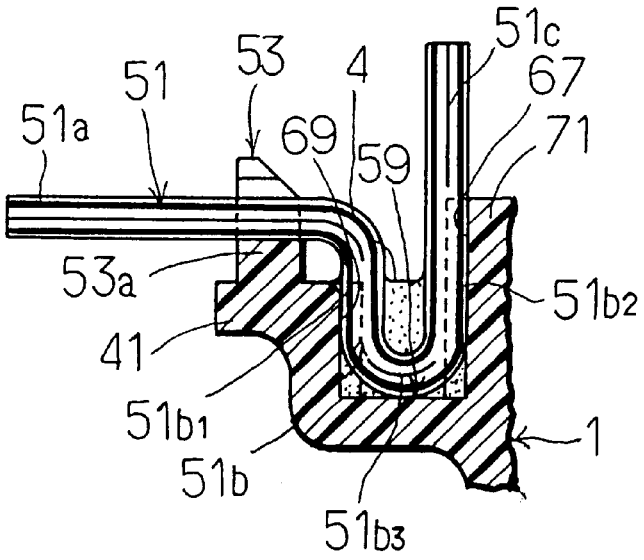
FIG. 6 is a sectional view of VI—VI line of FIG. 3.

As the terminals 51 and 55 have the same configuration, the construction of the terminal 51 will be described referring to FIG. 6 showing the VI—VI cross sectional view of FIG. 3. The terminal 51 is formed by bending a wire conductor, which is bendable and has a degree of rigidity, such as, for example a piano wire. The terminal 51 comprises a held portion 51*a* held by a pair of holding elements 53*a*, 53*a*, a lead wire connected portion 51*c* to which the lead wire for connection is connected by soldering and a connecting portion 51*b* between the held portion 51*a* and the lead wire connected portion 51*c* for connecting both portions. The connecting portion 51*b* comprises a first linear connecting portion 51*b*1, one end of which is connected to the held portion 51*a*, a second linear connecting portion 51*b*2 opposing to the first linear connecting portion 51*b*1 and one end of which is connected to the lead wire connected portion 51*c* and a U-shaped curving connecting portion (interconnecting portion) 51*b*3 for connecting the other ends of each first linear connecting portion 51*b*1 and second linear connecting portion 51*b*2. The curving connecting portion 51*b*3 is constructed to exert a spring force over the first linear connecting portion 51*b*1 and the second linear connecting portion 51*b*2 to be apart from each other when the first linear connecting portion 51*b*1 and the second linear connecting portion 51*b*2 are placed closer. The spring force serves to prevent the terminal 51 from coming out from a connecting portion receiving recess 59.

Referring to FIG. 3, the terminal fixing portion 41 is formed with connecting portion receiving recesses 59 and 61, adjacent to the terminal holding portions 53 and 57 for receiving the connecting portions 51*b* (FIG. 6) of the terminals 51 and 55. The connecting portion receiving recesses 59 and 61 communicate with the board receiving chamber 3 through communication grooves 63 and 65. Thus, insulating resin used in forming an insulating resin layer 4 formed by charging the insulating resin on the rear side of the insulating board (not shown) flows into the connecting portion receiving recesses 59 and 61 through the communication grooves 63 and 65. To allow the insulating resin to flow into the recesses easily, the communication grooves 63 and 65 may be declined toward the connecting portion receiving recesses 59 and 61 from the board receiving chamber 3.

Figure 7:
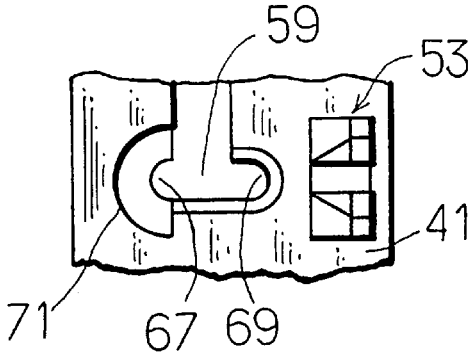
FIG. 7 is an enlarged view of a connecting portion receiving recess.

As exemplified in FIG. 7, the walls surrounding the connecting portion receiving recess 59 (or 61) are provided with a pair of fit grooves 67 and 69 for fitting the first linear connecting portion 51*b*1 and the second linear connecting portion 51*b*2 each at a pair of walls opposite to the first linear connecting portion 51*b*1 and the second linear connecting portion 51*b*2 of the terminal 51 shown in FIG. 6. The dimensions of the fit groove 67 or 69 is decided to allow the insulating resin 4 to flow between the first linear connecting portion 51*b*1 and the second linear connecting portion 51*b*2 of the terminal 51 and the fit grooves 67 and 69. The terminal 51, in the previously described state that the spring force occurs, the first linear connecting portion 51*b*1 and the second linear connecting portion 51*b*2 are fitted in the fit grooves 67 and 69, respectively. In other words, the distance between the fit grooves 67 and 69 is so decided to place the first linear connecting portion 51*b*1 and the second linear connecting portion 51*b*2 closer to generate the spring force. The connecting portion receiving recess 61 corresponding to the terminal 55 is also formed with a pair of fit grooves 67 and 69. As the fit groove 67 or 69 is formed into a semicircle in the cross section, the terminal 51 is so fixedly positioned that the first linear connecting portion 51*b*1 and the second linear connecting portion 51*b*2 are fitted into the fit grooves 67 and 69, respectively. Thus, when the insulating resin is charged in the connecting portion receiving recesses 59 and 61, the terminal is not necessarily supported by a specific means. To keep the terminal properly positioned until the charged insulating resin is hardened, the connecting portion 51*b* and the connecting portion receiving recess 59 of the terminal 51 are designed, so that the construction facilitates the terminal fixing as the terminal does not incline or move until the charged insulating resin for fixing the terminal is hardened. The construction of the terminal 51 and the connecting portion receiving recess 59 definitely prevent the terminal 51 from rotating about the held portion 51*a* or moving toward the direction that the held portion 51*a* extends, as the first linear connecting portion 51*b*1 and the second linear connecting portion 51*b*2 are fitted into the fit grooves 67 and 69, respectively. The construction also prevents the connecting portion 51*b* of the terminal from coming out easily from the connecting portion receiving recess 59.

The terminal fixing portion 41 is integrally formed with extension walls 71 and 73 (FIG. 3) projecting vertically away from the surface of the terminal fixing portion 41 to extend the fit groove 67, one of the grooves in the connecting portion receiving recess 59 or 61 in which the second linear connecting portion 51*b*2 is fitted at the side of the board receiving chamber 3. The extension wall 71 or 73 is formed into a semicircle in the cross section. The extension wall 71 or 73 serves to support the base portion of the lead wire connected portion 51*c* connected to the second linear connecting portion 51*b*2 to protect the lead wire connected portion 51*c* from being easily bent even if the excessive force is applied to the lead wire connected portion 51*c* when the lead wire is connected to the lead wire connected portion 51*c*.

One of two lead wires from the capacitor C2 (FIG. 5) is connected to the terminal 51 by soldering after winding around, while the other lead wire is connected to a terminal 75, which corresponds to the terminal T3' in FIG. 5. One of two lead wires from the capacitor C1 (FIG. 1) is connected to the terminal 55 by soldering after winding around, while the other lead wire is connected to an input terminal 85 described later, which corresponds to the terminal T1 in FIG. 5. A terminal 79, corresponding to the terminal T9 in FIG. 5, indicates a contact of the insulating substrate (not shown), that is, the variable resistor substrate, and the fixed resistor circuit board 5. The fixed resistor circuit board 5 is held between engaging elements 81 and 83 (FIG. 3) provided at the bottom of the electric component receiving chamber 7. The reference numeral 85 (FIG. 3, FIG. 4), corresponding to the terminal T1 in FIG. 5, indicates an input terminal fixed at a corner of the electric component receiving chamber 7. The reference numerals 87 and 89 (FIG. 3, FIG. 4) are lead wires extending from the fixed resistor circuit board 5.

Figure 8:
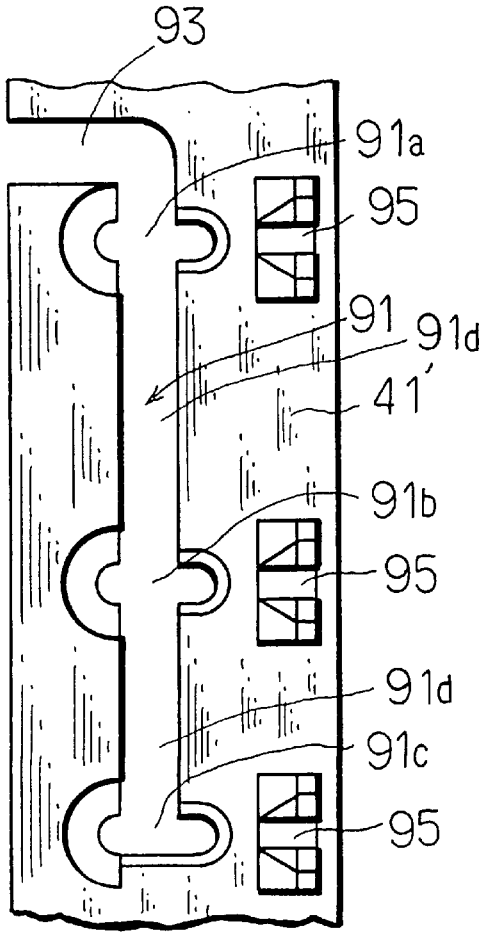
FIG. 8 is an enlarged view of connecting portion receiving recesses provided for a plurality of terminals.

In the embodiment described above, the terminals 51 and 55 each are provided with the connecting portion receiving recesses 59 and 61, respectively, however, in case the terminals are positioned adjacently, the connecting portion receiving recesses 59 and 61 may be provided with a communication groove to thereby communicate with each other. FIG. 8 shows a construction of providing a communication groove 91*d* formed on a terminal fixing portion 41' of the insulating casing 1. The communication groove 91*d* allows three connecting portion receiving recesses 91*a* to 91*c* for three terminals to communicate with each other. In this example, the terminal fixing portion 41' is formed with a recess 91 in a longitudinal direction, which has connecting portion receiving recesses 91*a* to 91*c* separately corresponding to each terminal. The construction of the connecting portion receiving recesses is basically the same as described in the former embodiment. The reference number 93 in FIG. 8 indicates a communication groove which allows the recess 91 to communicate with the board receiving chamber, and the reference numeral 95 is a terminal holding portion. The construction enables efficient charging of the insulating resin into the recess 91 and reducing time and cost for manufacturing.

Figure 9A:
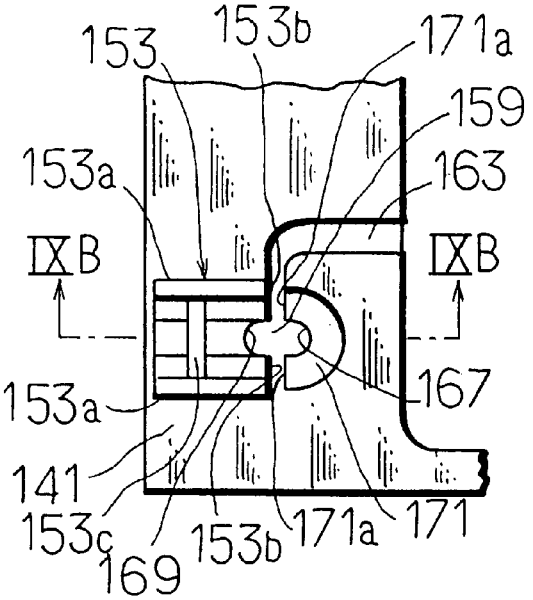
FIG. 9A is a partial plan view showing a terminal attachment structure used in another embodiment according to the present invention.
Figure 9B:
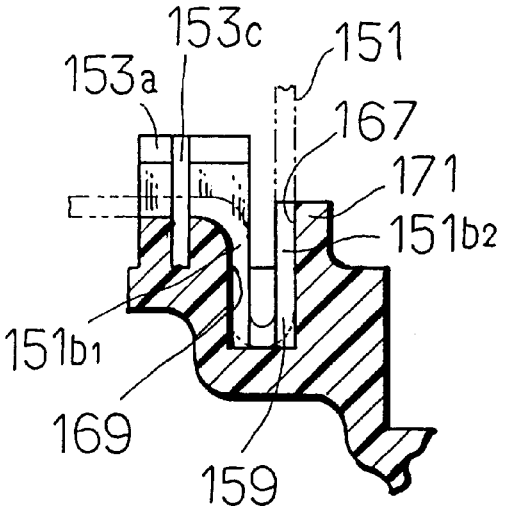
FIG. 9B is a sectional view of IXB—IXB line of FIG. 9A.

FIG. 9A and FIG. 9B are a partial plan view and a sectional view showing another construction of the terminal attachment structure in accordance with the present invention. In these figures, the elements which are the same as shown in FIG. 6 and FIG. 7 are bearing the indication number adding 100 to the indication number of the elements shown in FIG. 6 and FIG. 7. In this structure, a terminal holding portion 153 is positioned adjacent to a connecting portion receiving recess 159. A fitting groove 169 at a side of a terminal holding portion 153 extends along with a wall of the terminal holding portion 153 which faces to the connecting portion receiving recess 159. An extension wall 171 has a pair of opposite wall surfaces or walls 171*a*, 171*a* which face to a pair of wall surfaces or walls 153*b*, 153*b* positioned either side of the filting groove 169 formed in the wall of the base portion of the terminal holding portion 153. A pair of spaces are formed between the walls 153*b*, 153*b* and between the opposite walls 171*a*, 171*a*, respectively, so that the insulating resin flowing into the connecting portion receiving recess 159 may penetrate into these spaces by action of surface tension. These spaces of little dimensions allow the resin to come up longer along a first linear connecting portion 151*b*1 and a second linear connecting portion and 151*b*2 of the terminal 151, resulting in enhancing the fixing strength of the terminal 151. In this embodiment, a U-shaped groove 153*c* is formed along a pair of inner walls of 153*a*, 153*a* of the terminal holding portion 153 and the base portion of the terminal holding portion 153.

Figure 10A:
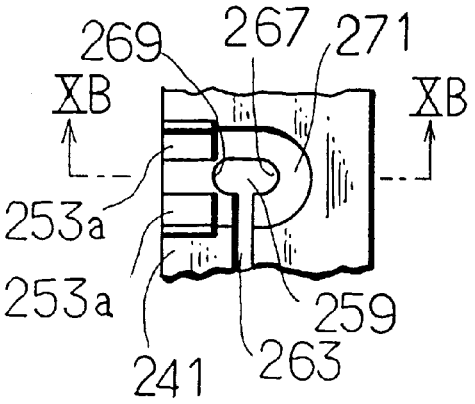
FIG. 10 is another partial plan view showing a terminal attachment structure used in another embodiment according to the present invention.
FIG. 10B is a sectional view of XB—XB line of FIG. 10A.
Figure 10B:
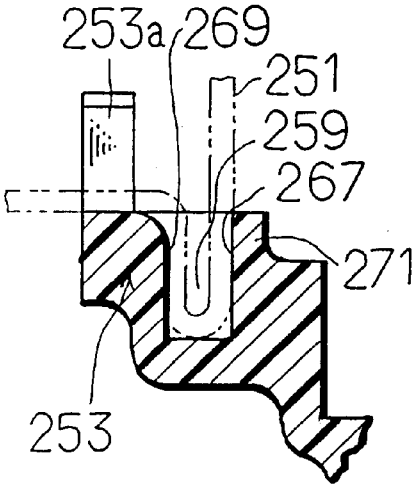

FIG. 10A and FIG. 10B are a partial plan view and a sectional view showing another construction of the terminal attachment structure in accordance with the present invention. In these figures, the elements which are the same as shown in FIG. 6 and FIG. 7 are bearing the indication number adding 200 to the indication number of the elements shown in FIG. 6 and FIG. 7. In this structure, a terminal fixing portion 241 is provided with an extension wall or projected wall 271, which extends away from the terminal fixing portion 241 and surrounds a connecting portion receiving recess 259 excepting for a portion for communicating with a communication groove 263 of the connecting portion receiving recess 259. The construction also allows the insulating resin flowing into the connecting portion receiving recess 259 through the communication groove 263 to come up longer along a first and a second linear connecting portions of the terminal 251 indicated by a broken line, resulting in enhancing the fixing strength of the terminal 251.

The above-described high voltage variable resistor unit is used as mounted to a transformer casing of the fly-back transformer. The fly-back transformer including such a high-voltage variable resistor unit as described above, can be molded by the insulating resin with the terminals embedded without upward movement or rotation. As various kinds of terminals are embedded in the insulating resin which molds the transformer, the fly-back transformer including a high-voltage variable resistor unit in accordance with the present invention is capable of greatly improving the yield rate.

In the above-described embodiment, the insulating resin charged in the board receiving chamber 3 is also charged in the connecting portion receiving recesses 59 and 61. However, the board receiving chamber and the connecting portion receiving recesses can be separated and the connecting portion receiving recesses can be charged with a different insulating resin from the resin charged in the board receiving chamber.

The entire disclosure of Japanese Patent Application No. 76734/1996, filed on Mar. 29, 1996, including specification, claims, drawings and summary are incorporated herein by reference in its entirety.

What is claimed is:

1. An electric component comprising:

an insulating casing having a one-side-open receiving chamber;

an electric element and a circuit board received in said receiving chamber;

a terminal fixing portion integrally formed with said insulating casing adjacent to said receiving chamber;

a terminal holding portion having a pair of holding elements provided on a surface portion positioned at the open side of said receiving chamber;

a terminal having a held portion held by said pair of holding elements and a lead wire connected portion connected to a lead wire by soldering, said lead wire extending from said electric element received in said receiving chamber;

said receiving chamber being partly filled with an insulating resin to a level so as to cover said circuit board;

said terminal having a connecting portion between said held portion and said lead wire connected portion, said connecting portion connecting said held portion to said lead wire connected portion;

said terminal fixing portion of said insulating casing defining a connecting portion receiving recess adjacent to said terminal holding portion, said connecting portion receiving recess receives said connecting portion of said terminal, said connecting portion receiving recess communicating with said receiving chamber through a communication groove;

said connecting portion of said terminal and said connecting portion receiving recess cooperating such that said terminal is maintained in a position wherein said connecting portion is received in said connecting portion receiving recess and said held portion of said terminal is held by said terminal holding portion; and, wherein said connecting portion receiving recess which receives said connecting portion of said terminal is filled with the insulating resin.

2. An electric component as defined in claim 1, further comprising a plurality of said terminals and wherein a plurality of said connecting portion receiving recesses are provided in said terminal fixing portion of said insulating casing, each of said plurality of connecting portion receiving recesses receiving one of said plurality of said terminals, said plurality of said connecting portion receiving recesses communicate with each other through a communication groove.

3. An electric component as defined in claim 1, wherein said terminal comprises a bent wire conductor, said connecting portion comprising a first linear connecting portion, a second linear connecting portion, and an interconnecting portion, said first linear connecting portion having a first end and a second end, said first end being connected to said held portion, said second linear connecting portion having a first end and a second end, said first end of said second linear conductor portion being connected to said lead wire connected portion, said interconnecting portion connecting said second end of the first linear connecting portion to the second end of the second linear connecting portion, said interconnecting portion being so constructed to generate a spring force when said first linear connecting portion and said second linear connecting portion are moved toward each other, walls surrounding the connecting portion receiving recess defining first and second fit grooves, said first fit groove receiving said first linear connecting portion and said second fit groove receiving said second linear connecting portion, and wherein said first linear connecting portion and said second linear connecting portion are moved toward each other as they are fitted in said a pair of fit grooves to cause said connecting portion to generate the spring force.

4. An electric component as defined in claim 3, wherein said terminal fixing portion is integrally formed with an extension wall portion, said extension wall portion having a portion of said second fit groove formed therein and thereby extends said second fit groove to position said second linear connecting portion away from said terminal fixing portion.

5. An electric component as defined in claim 4, wherein said terminal holding portion is disposed adjacent to said connecting portion receiving recess, said extension wall portion has a pair of opposite walls which face toward said terminal holding portion, and wherein a pair of spaces are defined between said terminal holding portion and said pair of extension wall portion opposite walls and thereby permit said insulating resin to flow upwardly through said pair of spaces by action of surface tension.

6. An electric component as defined in claim 3, wherein said terminal fixing portion is formed with a projected wall which projects away from said terminal fixing portion, said projected wall at least partially surrounding said connecting portion receiving recess and having an open portion for communicating with a communication groove of said connecting portion receiving recess.

7. A variable resistor unit comprising:

an insulating substrate having a rear surface and a front surface, said front surface having a variable resistor circuit pattern formed thereon;

an insulating casing defining a substrate receiving chamber which receives said insulating substrate, said insulating casing comprising a wall section;

a slider which is in sliding engagement with said variable resistor circuit pattern, said slider being disposed between said surface of said insulating substrate and said wall section of said insulating casing;

a slider operation portion provided with said slider, said slider operation portion having an operation shaft rotatably extending through said wall section of said insulating casing;

an insulating resin layer formed by charging an insulating resin into said substrate receiving chamber of said insulating casing and onto said rear surface of said insulating substrate;

a terminal fixing portion formed integrally with said insulating casing;

a terminal holding portion having a pair of holding elements formed integrally at a rear side of said terminal fixing portion;

a terminal formed from a bent wire conductor and having a held portion, a lead wire connected portion, and a connecting portion, said held portion extending in a first direction and being held by said pair of holding elements, said lead wire connected portion being connected to a lead wire by means of soldering, said connecting portion connecting said held portion to said lead wire connected portion;

said terminal fixing portion of said insulating casing defining a connecting portion receiving recess for receiving said connecting portion of said terminal adjacent to said terminal holding portion, said connecting portion receiving recess communicating with said substrate receiving chamber through a communication groove and said insulating resin for forming said insulating resin layer being charged in said connecting portion receiving recess through said communication groove;

said connecting portion of said terminal and said connecting portion receiving recess preventing said terminal from rotating about said held portion and from moving in said first direction while said connecting portion is received in said connecting portion receiving recess and said held portion of said terminal is held by said terminal holding portion;

wherein said connecting portion receiving recess which receives said connecting portion of said terminal is filled with the insulating resin.

8. A variable resistor unit as defined in claim 7, wherein said terminal holding portion is positioned adjacent to said connecting portion receiving recess.

9. A variable resistor unit as defined in claim 7, further comprising a plurality of said terminals and wherein a plurality of said connecting portion receiving recesses are provided in said terminal fixing portion of said insulating casing, each of said plurality of connection portion receiving recesses receives one of said plurality of said terminals, said plurality of connecting portion receiving recesses communicate with each other through a communication groove.

10. A variable resistor unit as defined in claim 7, wherein said connecting portion comprises a first linear connecting portion, a second linear connecting portion, and a curved connecting portion, said first linear connecting portion having a first end and a second end, said first end being connected to said connected portion, said second linear connecting portion having a first end and a second end, said first end of said second linear connecting portion being connected to said lead wire connected portion, said curved connecting portion being connected between said second end of said first linear connecting portion and said second end of said second linear connecting portion;

said terminal fixing portion of said insulated casing having a plurality of walls which define said connecting portion receiving recess, said plurality of walls including a first wall facing toward said first linear connecting portion and a second wall facing toward said second linear connecting portion, said first and second walls each being formed with a fit groove which receives said first linear connecting portion and said second linear connecting portion, respectively; and said insulating resin penetrating into a space between said first linear connecting portion and second linear connecting portion and said a pair of fit grooves.

11. A variable resistor unit as defined in claim 10, wherein said terminal fixing portion is integrally formed with an extension wall portion, said extension wall portion having a portion of said second fit groove formed therein and thereby extends the second fit groove for fitting with said second linear connection portion in a direction to project away from said terminal fixing portion.

12. A variable resistor unit as defined in claim 7, wherein said lead wire extends from an electric component which is electrically connected to an electrode, said electrode being provided by said variable resistor circuit pattern.

13. A variable resistor unit as defined in claim 7, wherein said insulating casing defines an electric component receiving chamber that receives an electric component, and said lead wire extends from said electric component.

* * * * *